United States Patent [19]

Heintges et al.

[11] 4,394,260

[45] Jul. 19, 1983

[54] CONTROL DEVICE FOR A ROTARY VALVE-CONTROLLED JIGGING MACHINE

[75] Inventors: Siegfried Heintges, Haltern; Werner Strauss; Karl-Heinz Weiffen, both of Bochum, all of Fed. Rep. of Germany

[73] Assignee: Klöckner-Humboldt-Deutz AG, Fed. Rep. of Germany

[21] Appl. No.: 311,873

[22] Filed: Oct. 15, 1981

[30] Foreign Application Priority Data

Oct. 15, 1980 [DE] Fed. Rep. of Germany ..... 3038921

[51] Int. Cl.[3] ..... B03B 5/24

[52] U.S. Cl. ..... 209/500

[58] Field of Search ..... 209/500

[56] References Cited

U.S. PATENT DOCUMENTS

| | | | |
|---|---|---|---|
| 901,474 | 10/1908 | Richards | 209/500 |
| 2,052,431 | 8/1936 | Wade | 209/502 |
| 2,811,257 | 10/1957 | Hisle | 209/500 |
| 2,828,015 | 3/1958 | Vissac | 209/502 |
| 3,073,450 | 1/1963 | Schanne | 209/502 |
| 4,176,749 | 12/1979 | Wallace et al. | 209/500 |
| 4,264,441 | 4/1981 | Heubner et al. | 209/500 |

FOREIGN PATENT DOCUMENTS

| | | | |
|---|---|---|---|
| 1197822 | 8/1965 | Fed. Rep. of Germany | 209/500 |
| 2411386 | 9/1975 | Fed. Rep. of Germany | 209/500 |
| 2539374 | 3/1977 | Fed. Rep. of Germany . | |

*Primary Examiner*—Tim R. Miles

*Attorney, Agent, or Firm*—Hill, Van Santen, Steadman, Chiara & Simpson

[57] ABSTRACT

A control apparatus for a rotary valve-driven jigging machine for processing coal or other minerals, particularly for a rotary valve-driven throughput jigging machine whose pulse chambers periodically are charged with compressed air in order to generate a pulse motion and are disposed under the jig screen, is characterized in that the level of the working air pressure in the pulse chambers is changed as a function of changes of the size of the stroke of the separating liquid. The change of the level of the working air pressure in the pulse chambers occurs by a controlled throttling of the outgoing air and/or of the incoming air.

9 Claims, 3 Drawing Figures

CONTROL DEVICE FOR A ROTARY VALVE-CONTROLLED JIGGING MACHINE

BACKGROUND OF THE INVENTION

1. Field of the Invention

The present invention relates to a control method and to a control device for a rotary valve-driven jigging machine for processing coal or other minerals, particularly for a rotary valve-driven throughput jigging machine whose pulse chambers are periodically charged with compressed air in order to generate a pulse motion and are disposed below the jigging screen.

2. Description of the Prior Art

With jigging machines for processing minerals, the lift of stroke, given a constant excitation intensity, depends on the thickness of the material layer lying on the jigging screen, particularly given throughput jigging machines which are pulsed from below. The cause lies in the attenuating influence of the minerals.

It is known from the German published application No. 25 39 374 to measure the layer height of the specifically heavier minerals given a jigging machine by means of a sensing element and, given an increase of the layer height, to increase the intensity of pulsation of the separating liquid. Such a control, however, depends greatly on the accuracy of the sampling of the layer height of the heavier minerals and is therefore inaccurate. Since there is an optimum lift of stroke for each grain size of the charging material, from which there should be no deviation given an unchanged grain size, the vitiation of the processing result can, under certain conditions, even occur by so doing.

SUMMARY OF THE INVENTION

The object of the present invention is to provide a control device for a jigging machine in which an accurate observation of the size of the set stroke of the separating liquid is achieved, in contrast thereto, even given differing mineral layer heights on the jigging machine bed.

The above object is achieved, according to the present invention, in that the level of the working air pressure in the pulse chambers is changed as a function of changes of the size of the stroke of the separating liquid. Therefore, that magnitude in the jigging process whose influencing most greatly changes the separating result is advantageously taken as the regulating variable. Further, an optimum operating point which has once been set can be maintained with certainty. The control can directly react to all changes of the stroke motion.

According to a particular feature of the invention, the change of the level of the working air pressure in the pulse chambers occurs by a controlled throttling of the outgoing air. Therefore, a particularly simple change of the level of the working air pressure can be achieved without changes being necessary at the jigging machine.

According to another feature of the invention, the change of the level of the working air pressure in the pulse chambers occurs by a controlled throttling of the outgoing air and incoming air. An additional throttling of the incoming air is provided when great fluctuations of the charging rate of the minerals make great changes of the working air pressure necessary in order to maintain the optimum stroke.

According to a further feature of the invention it is provided that the size of the stroke of the separating liquid is continuously measured by at least one measuring device, being preferably electrically measured. By means of an electrical measurement, for example with the assistance of a probe, there derives a particularly accurate determination of the respective lift stroke which is far superior in terms of accuracy to a mechanical sensing. It is thereby provided that the size of the stroke of the separating liquid is maintained constant within prescribed limiting values and that the control of the size of the stroke of the separating liquid occurs automatically with the assistance of an electronic control system. Due to the employment of metal-oxide-semiconductor (MOS) modules in integrated circuits, electronic control systems are very reliable. At the same time, such a control is possible with previously-unattainable accuracy given immediate response. Overall, there is provided a control of a jigging machine, according to the present invention, which operates very accurately, responds immediately and exhibits a high degree of availability.

In order to implement the present invention, a rotary valve-driven jigging machine having pulse chambers disposed below the jigging screen is provided, exhibiting a throttling valve in the outgoing air and/or in the incoming air line which is connected to a control system.

According to a further feature of the invention, the jigging machine has at least one probe per pulse chamber. With a probe in a respective pulse chamber, the pulse motion is measured at a particularly protected location at which no disruptions can occur due to the sinks. The pulse chamber and the jigging space are connected to one another in the manner of communicating pipes, so that a measurement of the pulse motion in the air chambers indicates the pulse motion on the jigging bed considering the respective translation of water motions due to different cross-sections. The accuracy of the control is thereby further increased by the arrangement of the probe in the pulse chambers, since the water path is greater here than on the jigging bed.

It is provided according to a further feature of the invention that the probes are connected to an electronic limiting value switch system, such as threshold switches. Therefore, the probe measurement can be advantageously employed for the control without time delay. A limiting value switch system is thereby particularly advantageous since it allows the machine to run within the limits of the optimum pulse range without control operations and allows control operations only given fluctuations which would influence the jigging result. Therefore, the number of control operations is significantly reduced.

According to a further feature of the invention, the control valves are designed as conical valves, particularly with a linear characteristic. By so doing, the control is particularly simplified. At the same time, the throttle valves are employed which are particularly insensitive to contamination, etc. It is further provided that the incoming air and the outgoing air throttle valve are mechanically and adjustably connected to one another. The mechanical connection of the valves, which is particularly designed in such a manner that the motion of the outgoing throttle valve amounts to a multiple of that of the incoming throttle valve, considerably simplifies the control of the two-valve throttle system.

BRIEF DESCRIPTION OF THE DRAWING

Other objects, features and advantages of the invention, its organization, construction and operation will be best understood from the following detailed description taken in conjunction with the accompanying drawings, on which.

DESCRIPTION OF THE PREFERRED EMBODIMENTS

Figure 1:
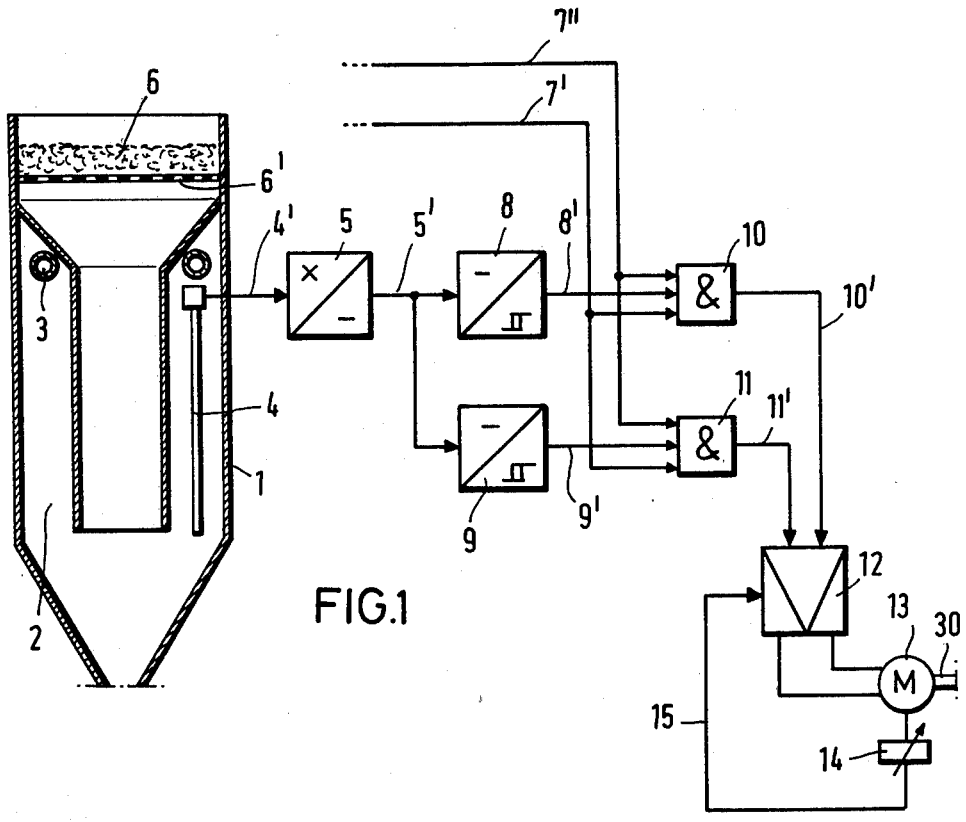
FIG. 1 is a schematic illustration of a jigging machine compartment of a throughput jigging machine having an electronic limiting value switch system constructed in accordance with the present invention.

Referring to FIG. 1, a jigging machine compartment 1 of a throughput jigging machine includes a pulse chamber 2 and a pair of working air intakes and discharges 3. A probe 4, for example a capacitively or inductively operating bar probe, whose signal 4' is forwarded to a transmitter 5 (an amplifier) is disposed in the pulse chamber 2.

The jigging screen 6' is disposed above the pulse chamber 2 with a layer of weld spar 6 being located on the jigging screen 6' through which the heavy components of the mineral mixture settled toward the bottom in order to be withdrawn, the screen structure being perforate, from the lower portion of the jigging compartment 1. The transmitter 5 generates a signal 5' in response to the signal 4', the signal 5' being fed to a limit or threshold value switch 8 for the upper limiting value and to a threshold or limiting value switch 9 for the lower limiting value. The switches 8 and 9 may be simple threshold-responsive switches and may comprise, for example, Schmitt trigger circuits. The analog response 4' of the probe 4 has therefore been converted to digital signals at the outputs of the threshold value switches 8 and 9. Upon transgression of the pre-set limiting value, the limiting value switches 8 and 9 emit signals 8' and 9', respectively, which are fed to respective AND gates 10 and 11. The AND gates 10 and 11 are also fed with a signal 7' which indicates that the valve control, for example the rotary valve control unit, is started up and a signal 7'' which indicates that compressed air is being provided at the rotary valve control. Given the application of the signals 7' and 7'', the signal 8' for the upper limiting value is produced and a signal 9' for the lower limiting value is produced and fed from the respective AND gates as signals 10' and 11' to a motor switch 12 which actuates a motor operator 13. The element 13 is a servomotor and has an output shaft 30 which reports its position back to the motor switch 12 by way of an answer control loop 14, 15. The output shaft of the motor 13, which may be an electromagnetic, linearly operating setting system instead, actuates a discharge throttle valve which is illustrated in greater detail in FIG. 2.

Figure 2:
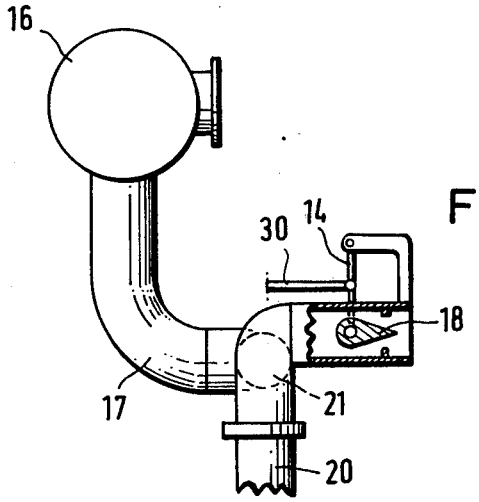
FIG. 2 is an illustration, partially in section, of a conical valve in an outgoing airline.

In FIG. 2, an air dome 16 is illustrated for storing working air and is connected by way of a line 17 to a rotary valve. Here, 20 and 21 respectively indicate the working airline from the rotary valve to the pulse chamber (not illustrated) and the rotary valve. The adjustable throttle valve 18, preferably a conical valve, is disposed in the discharge line, the throttle valve 18 being actuated by way of the setting device and the schematically indicated setting motor shaft 30, for example the output shaft of the drive motor 13 illustrated in FIG. 1.

Figure 3:
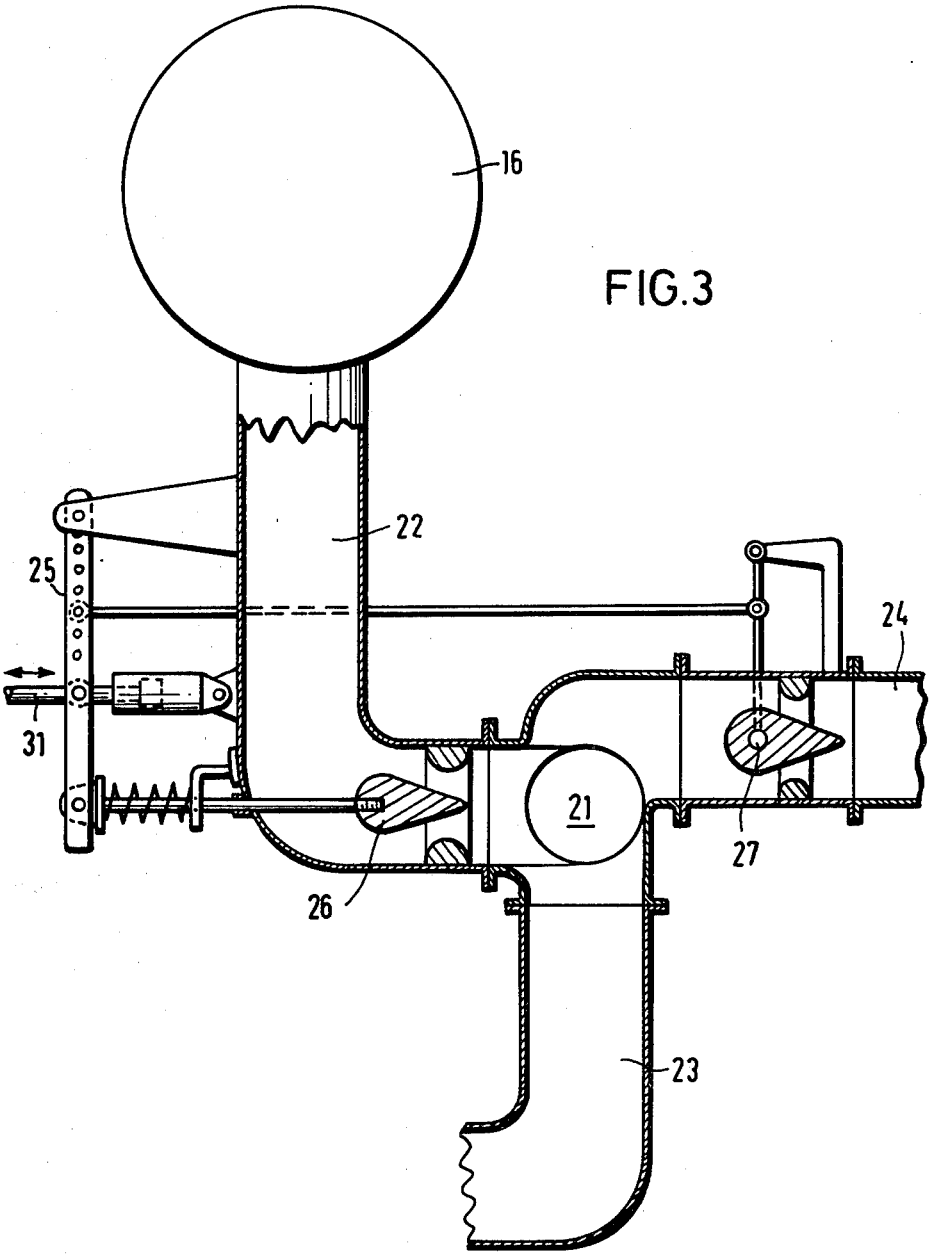
FIG. 3 is an illustration, again partially in section, of an incoming air valve and an outgoing air valve which are mechanically coupled to one another.

In FIG. 3, the air dome 16 is again illustrated as connected in communication with a rotary valve 21 via a line 22. A conical valve 26 and a conical valve 27 are built into the supply line 23 and into the discharge line 24, respectively. The two valves are advantageously connected to one another via a mechanical setting system which can be adjusted in terms of motion transmission and which is provided with oscillation dampers, etc. The actuation of the setting system 25 occurs via the setting arm 31, which may correspond to the output shaft 30 of the motor 13 or an equivalent linear-operating structure. The double-valve embodiment is particularly suited for jigging machines having high-charging fluctuations of the jigging material.

The control described above with respect to the present invention has particularly been developed for small coal jigging machines. It can, however, be employed for all throughput jigging machines and for discharge jigging machines as well. The fact that the optimum jigging stroke is observed, even given fluctuating charging amounts, is always achieved. The type of mineral to be separated and the type of the discharge do not influence the control.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. Apparatus for controlling a rotary valve jigging machine which has an air chamber disposed in a separating liquid below a jigging screen and air is supplied to and exhausted from the air chamber through inlet and outlet air lines, respectively, comprising: sensing means in the air chamber for producing an electrical signal corresponding to the stroke of the liquid pulsations; an outlet throttling valve in said outlet air line; and control means connected between said sensing means and said throttling valve for adjusting said throttling valve in response to the electrical signal being outside predetermined limits, said control means comprising first and second means connected to said sensing means and responsive to the magnitude of said electrical signal to produce respective first and second signals when said electrical signal transgresses respective predetermined upper and lower threshold values, and electrical servomechanism means connected between said first and second means and said throttling valve for adjusting said throttling valve in response to said first and second signals.

2. The apparatus of claim 1, wherein:

said machine has a plurality of air chambers; and comprising a plurality of electric probes each in a respective one of said chambers.

3. The apparatus of claim 1, wherein:

said sensing means comprises an electrically-operating probe; and said control means includes an upper and lower limit switch connected to said probe.

4. The apparatus of claim 1, and further comprising:
an inlet throttling valve in the inlet line connected to and operated by said control means.

5. The apparatus of claim 4, wherein:
said throttling valves are conical throttling valves.

6. The apparatus of claim 4, wherein:
said throttling valves are mechanically coupled together.

7. The apparatus of claim 4, wherein:
said throttling valves are adjustably mechanically coupled together.

8. The apparatus of claim 1 wherein:
said servomechanism means comprises a servomotor.

9. The apparatus of claim 1, wherein:
said servomechanism means comprises an electromagnetic, linearly operating setting system.

* * * * *